US005173173A

United States Patent [19]

Vauk

[11] Patent Number: 5,173,173

[45] Date of Patent: Dec. 22, 1992

[54] TRACE CONTAMINANT REMOVAL IN DISTILLATION UNITS

[75] Inventor: Dennis A. Vauk, Santa Ana, Calif.

[73] Assignee: Union Oil Company of California, Los Angeles, Calif.

[21] Appl. No.: 589,671

[22] Filed: Sep. 28, 1990

[51] Int. Cl.[5] ..... C10G 61/06

[52] U.S. Cl. ..... 208/91; 208/213; 208/246; 208/310 R; 208/348; 208/369; 208/92; 208/134; 585/820; 585/825

[58] Field of Search ..... 208/348, 369, 91, 92, 208/310 R, 213, 246; 585/820, 825

[56] References Cited

U.S. PATENT DOCUMENTS

| | | | |
|---|---|---|---|
| 1,399,792 | 12/1921 | Prutzman | 208/369 |
| 1,560,137 | 11/1925 | Bernard | 208/369 |
| 1,569,855 | 1/1926 | Egloff | 208/348 |
| 1,674,852 | 6/1928 | Clarke | 208/369 |
| 1,676,724 | 7/1928 | Becker | 208/348 |
| 1,962,153 | 6/1934 | Peterkinjr | 208/369 |
| 2,002,340 | 5/1935 | Cox | 208/369 |
| 2,367,284 | 1/1945 | Kaplan | 208/369 |
| 2,403,672 | 7/1946 | Matuszak | 260/683.2 |
| 3,132,074 | 5/1964 | Epperly et al. | 208/369 |
| 3,376,356 | 4/1968 | Freitas et al. | 208/310 |
| 4,138,230 | 2/1974 | Thompson | 208/213 |
| 4,194,964 | 3/1980 | Chen et al. | 208/213 |
| 4,215,011 | 7/1980 | Smith, Jr. | 252/426 |
| 4,645,587 | 2/1987 | Kokayeff | 208/91 |
| 4,695,366 | 9/1987 | Miller et al. | 208/91 |
| 4,831,206 | 3/1988 | Zarchy | 208/213 |
| 4,849,569 | 7/1989 | Smith, Jr. | 585/446 |
| 4,886,935 | 12/1989 | Kokayeff | 208/213 |

*Primary Examiner*—Helane Myers

*Attorney, Agent, or Firm*—Alan H. Thompson; Gregory F. Wirzbicki

[57] ABSTRACT

A hydrocarbon feedstock is simultaneously distilled into two or more fractions while trace concentrations of contaminants in the feedstock are absorbed onto a sorbent packing material during distillation operation. The sorbent packings contain active metal components supported on porous refractory oxides. Such sorbent packings provide surfaces for mass transfer in the distillation process and concurrently absorb contaminants. Product boiling fractions from the absorption-distillation process are further processed over contaminant-sensitive catalysts such as reforming or isomerization catalyst.

30 Claims, 2 Drawing Sheets

TRACE CONTAMINANT REMOVAL IN DISTILLATION UNITS

The invention relates to a process for concurrent removal of sulfur or other contaminants from a hydrocarbon-containing feedstock and separation of hydrocarbon-containing fractions in a distillation unit.

BACKGROUND OF THE INVENTION

In a distillation unit in a petroleum refining operation, hydrocarbon-containing feedstocks are ordinarily separated in distillation columns (towers) by at least a portion of a liquid being vaporized and the vapor then being physically separated from the liquid and usually condensed to a liquid, either within or outside the column. For instance, a full-range naphtha containing a heavy and light boiling fraction is heated in a distillation column to vaporize the light naphtha fraction which is recovered overhead while the heavy naphtha liquid fraction is recovered from the bottom. The distillation columns typically contain either trays or packings to regulate fluid flow through the column. The usual purpose of packings in a packed refinery distillation column is to bring a current of gas or vapor into intimate contact with a liquid stream and vice versa, and create flow paths for the liquids. In general, packed refinery distillation columns are operated countercurrently, that is, the liquid enters the tower at the top, where it is distributed over the packing by means of a specially designed distributor, and the gas or other liquid enters at the base of the column.

In a combined catalyst-distillation process as disclosed in U.S. Pat. No. 4,215,011 issued to Smith, a catalyst bed contained in a distillation column is contacted with a feedstock, such as a mixture of isobutene and n-butene, under reaction conditions to chemically change a substantial proportion (more than a trace) of the feedstock components (i.e., greater than 0.01 weight percent and typically a major proportion of the feedstock components) to convert them to at least one different product from that contained in the feedstock, such as diisobutene, and the product is concurrently removed from the column by distillation. Such a process and other processes of the same nature typically involve equilibrium-driven reactions wherein the forward reaction has an increased driving force because the reaction products have been removed and cannot contribute to a reverse reaction (LeChatelier's Principle).

However, in the common scheme of refining crude oil, both crude and processed hydrocarbon-containing boiling fractions are physically separated by distillation in packed columns into product hydrocarbons, without change of chemical composition of the feedstock compounds, and subsequently are catalytically upgraded to more valuable hydrocarbon-containing products. For instance, a vacuum gas oil fraction is catalytically hydrocracked and the products subsequently distilled to boiling fractions such as diesel fuel, jet fuel, heavy naphtha and light naphtha.

Such cracked naphthas, as well as straight run naphtha feedstocks (including light, heavy and full range naphthas), are often upgraded in other processes, such as catalytic reforming and isomerization, by increasing the octane number of the feedstock's gasoline fraction. In a typical reforming process in which a straight run or cracked naphtha is upgraded, the feedstock is contacted with a catalyst comprising a noble metal on alumina. The conditions utilized in the reforming process will vary depending upon, among other factors, the type of feed being processed and the desired increase in octane level. The catalysts employed in the reforming process, particularly those containing platinum, and most particularly those comprising platinum, rhenium and chlorine, are poisoned or deactivated rapidly in the presence of sulfur components. Thus, to achieve maximum run lengths and increase process efficiency, it is necessary to reduce the sulfur content of reformer feedstocks as low as possible.

One common method of removing sulfur compounds from reformer and related feedstocks is to subject the feedstock to catalytic hydrodesulfurization by contacting the feedstock with molecular hydrogen in the presence of a sulfur-tolerant hydrotreating catalyst. The sulfur compounds in the hydrocarbon stream are converted to hydrogen sulfide, which may be separated from the hydrocarbon stream by conventional means prior to subjecting it to reforming. Although highly effective sulfur removal may be achieved by catalytic hydro-desulfurization, the efficiency of the process is ultimately limited by equilibrium and/or kinetic considerations. In general, it is not possible to obtain hydrodesulfurized products containing less than about 0.5 ppmw sulfur as is desired in most reforming operations. Furthermore, it is impossible to guard against upsets in the catalytic hydrodesulfurization units which can result in high levels of organosulfur compounds (such as mercaptan sulfur) remaining in the reformer feedstock.

In addition to being highly sensitive to sulfur components, reforming catalysts are also poisoned by compounds containing silicon. One common source of hydrocarbon streams containing silicon compounds is the delayed coking unit used to convert residual oils into more valuable products. The overhead vapors from the coking drum, which is part of the delayed coking unit, are normally distilled (fractionated) into various cuts including a gasoline boiling range stream commonly referred to as coker gasoline or coker naphtha. This stream generally possesses a low octane number and is therefore unsuitable for use as an automotive fuel without upgrading. Thus, it has become common practice to increase the octane number of coker gasoline by subjecting it to catalytic reforming. The coker gasoline will not only normally contain sulfur compounds but, quite frequently, will contain organosilicon components derived from silicon defoamers, such as polydimethyl siloxanes, added in the delayed coking process to prevent foaming.

In view of the above, it is desirable to remove contaminants such as sulfur compounds and silicon compounds from coker gasoline, jet fuels, and other hydrocarbon streams, including straight run and cracked naphthas (i.e., products from crude oil fractionation, fluid cracking catalysts, hydrocracking, and the like) that are to be processed in catalytic reformers or isomerization units. If a feedstock stream containing both sulfur and silicon compounds is subjected to catalytic hydrodesulfurization or hydrotreating, the sulfur will not only be removed by conversion to hydrogen sulfide but the silicon compounds will deposit on the catalyst. It is, however, not desirable to use the hydrotreating catalyst to remove silicon components from reformer feedstreams. After a certain amount of silicon deposits on the catalyst, complete removal of silicon compounds will no longer take place, and the effluent from the hydrotreating unit will contain at least trace concentrations of organosilicon components which will irreversibly poison the reforming catalyst. Moreover, the deposited organosilicon components will have a deleterious effect on the hydrotreating catalyst, tending to poison it and decrease its effectiveness.

In addition to hydrotreating, there are other processes, particularly hydrodesulfurizaton, employing catalytically active materials for removing sulfur and/or silicon from hydrocarbons. Such processes reduce the sulfur or silicon content of the hydrocarbon by "absorbing" sulfur therefrom by employing a sorbent material under nonhydrogenative conditions in a separate packed bed absorption unit located upstream of the reforming unit. Typically, nonhydrogenative conditions include contact of the sorbent material with the feedstock in the absence of hydrogen; however, if desired, hydrogen is sometimes present, but only in amounts or under conditions that prevent essentially any hydrogenation of the organosulfur components in the feedstock. Usually, the sorbent material contains a metal component, such a nickel, copper, zinc or silver, and the feedstocks generally treated are reformer feedstocks, particularly naphthas. Typical of such processes include those disclosed in U.S. Pat. Nos. 2,755,226 and 4,695,366 to Annable and Miller et al., respectively, wherein a bed of copper components supported on porous carriers is used to reduce the sulfur content of reformer feedstreams.

SUMMARY OF THE INVENTION

The invention involves a process for separating hydrocarbon-containing feedstocks into various boiling fractions by distillation and concurrently removing contaminants from one or more of the fractions by absorption. In the present invention, the packings in a typical packed distillation column are partially or completely replaced with a sorbent packing material which provides a dual function for the distillation column, e.g., the traditional packing function of providing a surface for mass transfer of the liquid and vapor components of the feedstock and product boiling fractions, and the concurrent function of absorbing contaminants from the feedstock onto the sorbent.

The sorbent packings are active metal component supported on porous refractory oxides and are capable of absorbing such contaminants as sulfur and silicon while being sufficiently wetted in the distillation column to provide a proper surface for mass transfer. Such packings are shaped to provide adequate void space in the distillation column for suitable mass transfer and also are of sufficient crush strength to support themselves therein.

An advantage of the invention is the elimination of separate refining units utilized solely for contaminant absorption. For instance, in a petroleum refining scheme, a trace sulfur removal unit upstream of a reformer or isomerization unit can be eliminated by employing the present absorption-distillation process. Furthermore, the present process allows for use of relatively inexpensive sorbent materials, including regenerated sorbent packing materials.

DETAILED DESCRIPTION OF THE INVENTION

Figure 1:
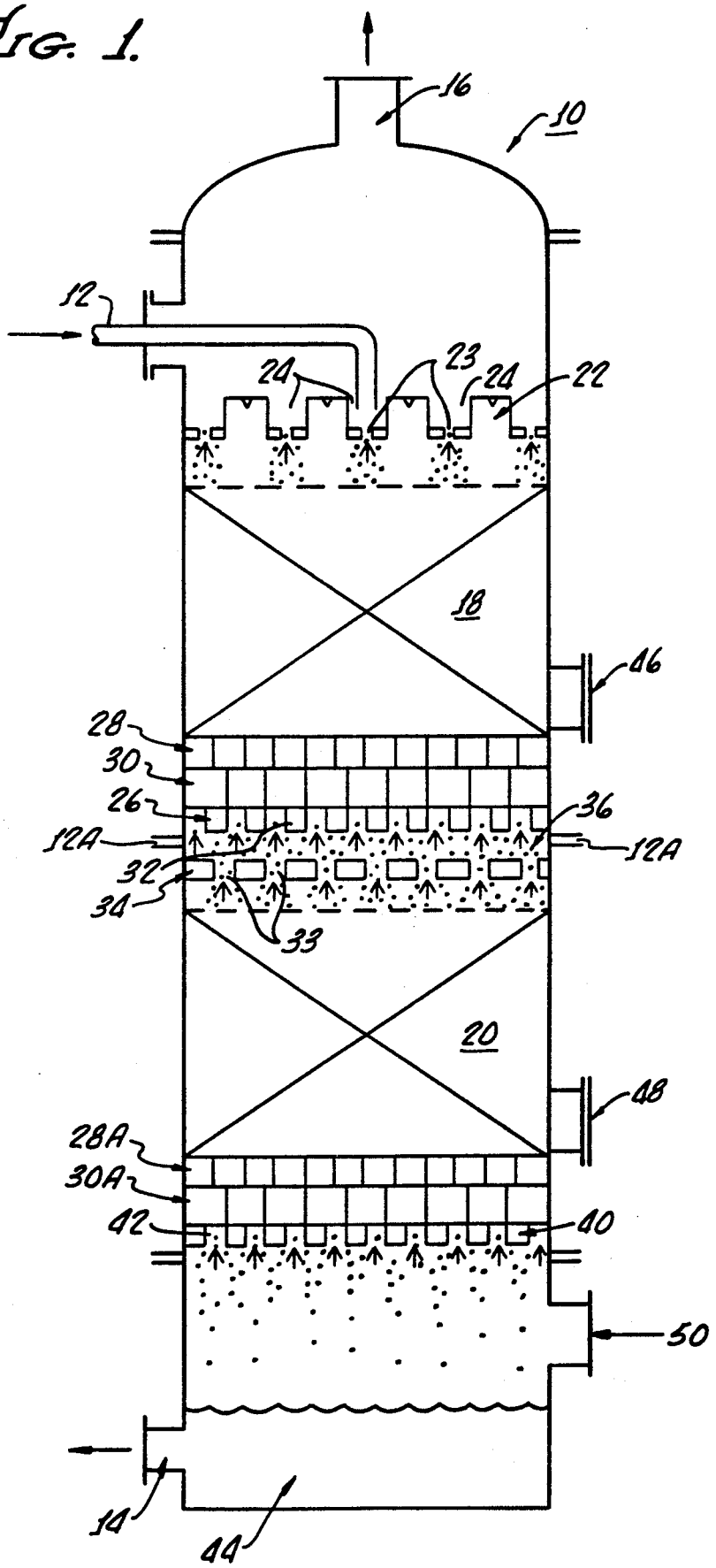
FIG. 1 is a side stripper fractionator employed in an absorption-distillation process of the invention for removing sulfur compounds from a full-range naphtha feedstock and concurrently separating a light naphtha therefrom.

The invention relates to an absorption-distillation process for separating at least one hydrocarbon-containing boiling fraction from a hydrocarbon-containing feedstock which contains contaminants and at least two different hydrocarbon-containing boiling fractions. Concurrently with the separation of feedstock components in a distillation column, contaminants are removed from the feedstock by contacting sorbent packings contained in a fixed bed in the packed distillation column. The sorbent is contacted by the feedstock in an absorption-distillation zone under conditions for concurrent contaminant absorption and hydrocarbon distillation. At least a portion of the contaminants from the feedstock are deposited onto the sorbent packings simultaneously with the distillation of the feedstock into at least two of its different hydrocarbon-containing boiling fractions.

The feedstocks contemplated for treatment by the present invention include those derived from petroleum, oil shale, tar sands, coal-derived liquids, and bituminous sands. Examples are full range naphthas, both straight run and refined naphthas, light naphthas, heavy naphthas, coker naphthas, virgin naphthas, cracked naphthas, reformer feedstocks, isomerization feedstocks, products from a hydrocracking process, distillate fuels, jet fuel, kerosene, gas oils, vacuum fractions, aromatics, recycle oils, cracked gasoline, and decant oils. Preferred feedstocks include any mixtures of light naphthas ($C_5$–$C_7$), heavy naphtha ($C_6$–450° F.b.p.), jet fuel (260°–575° F.b.p.), diesel fuel (280°–720° F.b.p.) from a crude unit, hydrotreating unit or hydrocracking unit, as well as unconverted oil from a hydrocracker.

The feedstocks treated by the process of the invention contain materials that contaminate downstream processing catalysts, refining vessels, and the like, or cause environmental pollution problems, etc. For instance, catalysts utilized to further upgrade hydrocarbon fractions of the feedstock are poisoned after sufficient contact and/or deposition thereon of contaminants contained in a feedstock. The contaminants contain elements such as sulfur, silicon, lead, arsenic, and the like. Sources of contaminants are frequently organo-contaminant compounds. Typical sources of sulfur-containing contaminants include organosulfur compounds such as mercaptans, disulfides and thiophenes, with mercaptan sulfur being a highly preferred target for removal from the contemplated feedstocks. Typical sources of silicon contaminants are organosilicon compounds such as those comprising antifoam agents in delayed coking processes, including silanes, silanols, and polysiloxanes. Normally the contaminants are found in the feedstock in trace concentrations, e.g., less than 0.01 weight percent, calculated as the monoatomic element, which are still significantly high for the aforementioned downstream refining purposes. The sulfur contaminants are typically found in the feedstock in a concentration less than about 100 ppmw, calculated as S, and preferably less than about 10 ppmw, but most preferably in the range from about 0.1 to about 2 ppmw. (Typically, conventional analytical methods can reliably detect as low as 0.1 ppmw of sulfur.) The silicon contaminants are usually found in the feedstock in a concentration between about 0.01 and about 25 ppmw, and typically between about 5 and about 15 ppmw, calculated as Si.

The sorbent packing materials usually contain at least one active metal component supported on a porous refractory oxide. The sorbent may be fresh, spent, or regenerated. The phrases "fresh sorbent", "spent sorbent", and "regenerated sorbent" as used herein refer respectively to a mixture of an active metal component and porous refractory oxide which has not previously been used to remove contaminant compounds from a hydrocarbon-containing feedstock, a mixture of active metal component and porous refractory oxide which has previously been used to remove contaminant compounds from a hydrocarbon-containing feedstock, and a mixture of active metal component and porous refractory oxide prepared by burning off carbonaceous material and/or contaminants accumulated on the sorbent from previous sorbent or other use. Preferred metal components contained on the sorbent are transition metals, including copper, nickel, zinc, iron, cobalt and molybdenum, typically in the oxide form, and usually in an amount greater than about 1 weight percent (calculated as the metal). The most highly preferred metal component is copper oxide. The copper components are usually present in the fresh sorbent packings from about 1 to about 75 weight percent, preferably about 5 to about 30 weight percent, and most preferably about 10 to about 20 weight percent, calculated as the metal.

Numerous porous refractory oxides may be utilized to support the metal components. Representative of such supports include alumina, silica, silica-alumina, zirconia, silica-zirconia, titania, and magnesia, and combinations thereof. However, the preferred support is alumina, most preferably gamma alumina having a surface area above about 100 $m^2/gm$, with the most preferred surface areas being between 150 and 400 $m^2/gm$. The refractory oxide usually comprises at least about 25 and preferably at least about 35 weight of the catalytic absorbent packing. The crushing strength of the support must be sufficient to prevent collapse of the catalytic absorbent packing when dumped onto one or more packing supports or trays in the distillation column and during operation of the process of the invention. The crushing strength is usually at least about 5 lbs./$\frac{1}{8}$ inch cross section, and preferably greater than about 10, and most preferably greater than about 15 lbs./$\frac{1}{8}$ inch.

The fresh sorbent packings are normally prepared by combining the metal component with the porous, inorganic refractory oxide component by comulling or by aqueous impregnation if the metal compound is soluble in water. Copper carbonate is a preferred copper compound when the sorbent packing is produced by comulling and copper nitrate is preferred when impregnation is utilized. Extrudates containing the metal components are usually calcined in the range from about 500° F. to about 1,200° F. to convert the metal components to the oxide form.

Figure 2:
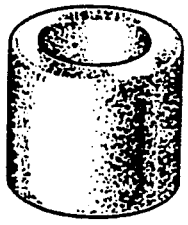
FIGS. 2–9 inclusive, contain shapes of the sorbent packings of the present invention.
Figure 3:
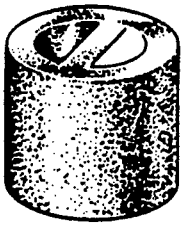
Figure 4:
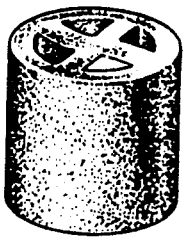
Figure 5:
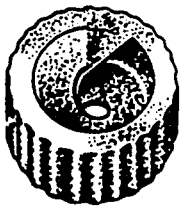
Figure 6:
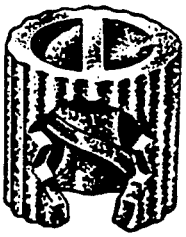
Figure 7:
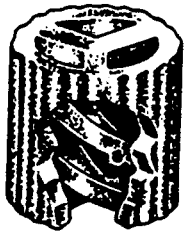
Figure 8:
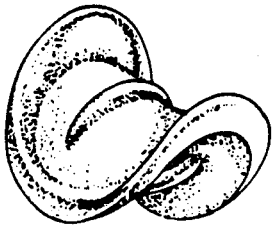
Figure 9:
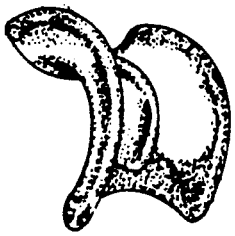

A sorbent packing material employed in the absorption-distillation zone in the distillation column has a particulate shape and cross-sectional dimension which provides both adequate mass transfer for wetting and phase separation during distillation as well as void space in the overall packings to create sufficient liquid flow paths. In other words, the shape of the sorbent packing particulate functions as a distillation packing particulate. Of course, it is also contemplated in the invention that there may be inert distillation packing in the distillation column also, such as, below or above the sorbent packing or intermixed into the sorbent packing. The particulates may have either a symmetrical or unsymmetrical cross-sectional shape, such as cylindrical or polylobal shape. Since the proportion of effective area in a bed of packing is at least partially dependent upon the liquid rate, the mode of charging the distillation column, the height and diameter of the column, and other related factors, the preferred shapes for the sorbent packing particulates are those which function as distillation tower packing and have such design. The shapes include examples such rings, saddles, or the like including those shown in FIGS. 2–9, i.e., the Pall ring, Lessing ring (FIG. 3), Cross partition ring (FIG. 4), Single spiral ring (FIG. 5), Double spiral ring (FIG. 6), Triple spiral ring (FIG. 7), Berl saddle (FIG. 8), Intalox saddle (FIG. 9), and the most highly preferred being the Raschig ring (FIG. 2). Such shapes are described in TOWER PACKINGS AND PACKED TOWER DESIGN, authored by Max Leva, second edition, Norton Chemical Process Products Division, 1953, the disclosure of which is incorporated by reference in its entirety herein.

The active metal component supported on the fresh sorbent is normally in the oxide form, or an active metal-containing compound which is converted to the oxide form, at, or just prior to, the temperature (and other essential conditions) of absorption of the contaminant onto the sorbent. The primary purpose for the presence of the active metal in the fresh sorbent is to react with the compounds containing the contaminants to convert the active metal oxide to the metal-contaminant form which remains deposited ("absorbed") on the spent sorbent. In other words, the sorbent does not function as a catalyst—the active metal component on the porous refractory oxide is a reactant along with the contaminant-containing compound of the feedstock in a reaction which is essentially non-reversible and the active metal-contaminant product compound is deposited onto the sorbent packing particulate. In the case of copper, it is believed that the copper component in the spent sorbent is in the form of copper sulfide produced by reaction of the copper component in the fresh sorbent with sulfur constituents (contaminants) in the hydrocarbon-containing feedstock treated with the fresh sorbent. It is believed that the copper or other metal component in the regenerated sorbent is in the sulfate form produced by the reaction of the sulfide with oxygen when carbonaceous and/or contaminant material is burned off the spent sorbent.

The conditions at which the sorbent is contacted with the feedstock containing contaminants in the absorption-distillation zone may vary widely and will normally depend upon the type of feedstock and accompanying contaminant(s), type of sorbent, and the type of distillation column to which the feedstock is passed, i.e., main fractionator, side stripper, or the like. The conditions of temperature, pressure and space velocity include those which are effective for simultaneous absorption of contaminants onto the sorbent and distillation of the components of the feedstock into the desired boiling fractions. The temperatures are less than those effecting substantial thermal cracking, conversion and/or coking of the components of the feedstock and range broadly from about 200° F. to about 700° F. while the pressure may vary from sub-atmospheric to about 1,000 p.s.i.g. and the space velocity from about 0.05 to about 100 LHSV. In preferred processes, such as when the contaminant-containing feedstock is a direct feed to a catalytic reformer, the temperature in the absorption-distillation zone will normally range from about 250° F. to about 450° F. and the pressure will vary from about atmospheric to about 400 p.s.i.g. The process is usually effective under nonhydrogenative conditions wherein added free hydrogen is not present in the absorption-distillation zone.

The distillation columns utilized in the process of the invention can include any packed or trayed column, or combinations thereof, which can separate from a feedstock two or more liquid fractions based on their differences in boiling ranges. Packed columns are preferred. Typical examples of distillation columns are primary or main fractionators, which usually separate a multicomponent hydrocarbon feedstock into three or more boiling fractions, and side stripper fractionators which separate lighter boiling fractions from heavier multicomponent boiling fractions. In the present invention, processing in the side stripper fractionator is preferred. In the general refining scheme of hydrocarbon-containing feedstocks, existing and newly constructed distillation columns located upstream of refining units employing contaminant-sensitive catalysts may conveniently provide an absorption-distillation zone for the process of the invention. The distillation columns, both main fractionators and side stripper fractionators, located upstream of reformer and isomerization catalytic units employing sulfur-intolerant catalysts, contain preferred absorption-distillation zones, particularly those reformer or isomerization units which are poisoned by feedstocks containing as little as 0.5 ppmw of sulfur, calculated as S.

In the present invention, a hydrocarbon-containing feedstock having different boiling fractions is physically separated into two or more of such boiling fractions of the feedstock by vaporization and/or condensation without a substantial change in chemical composition of the components of the feedstock, i.e., with very little or extremely minor change in chemical composition of the feed components. In the process of the invention, the trace concentrations of contaminants absorbable onto the sorbent are in an approximate stoicometrical mole ratio with the amount of active metal component supported on the porous refractory oxide of the sorbent. As the contaminants are deposited on the sorbent during the course of processing (i.e. as the fresh sorbent is converted to spent sorbent), the separating boiling fractions of the feedstock (by distillation) are not influenced by such deposition in the manner of equilibrium-driven processes.

At least one of the product hydrocarbon boiling fractions from the process of the invention has a reduced contaminant concentration of at least about 50 percent less than the concentration of contaminants in the feedstock. Typically, at least one product boiling fraction contains less than about 1 ppmw, preferably less than 0.5 ppmw, and most preferably less than 0.1 ppmw of contaminant, calculated as the monoatomic element. Thus, in the case of contaminants containing sulfur and/or silicon, the product concentrations are calculated as S and/or Si, respectively.

Under typical distillation conditions employed in the present invention, the sorbent packings contained in the absorption-distillation zone in the distillation column are suitably wetted for concurrent absorption of the contaminants and distillation of the boiling fractions. The sorbent packings provide a surface area which allows vaporization of a lower boiling fraction from the multicomponent liquid feedstocks wetted thereon.

FIG. 1 illustrates a specific embodiment of the process of the invention in which a full range liquid naphtha feedstock containing mercaptan sulfur contaminants is distilled in a distillation column to separate a light naphtha boiling fraction from a heavy naphtha boiling fraction, and the mercaptan sulfur concurrently is absorbed onto a fresh sorbent containing copper oxide on an alumina support particulate shaped in the form of Raschig rings which are shown is FIG. 2. The liquid naphtha feedstock is passed from a main fractionator (not shown) to a cylindrical side stripper 10 (distillation column) through inlet line 12 to separate a heavy naphtha boiling fraction which exits a bottom-located stripper outlet 14 and a light naphtha boiling fraction which exits a top-located stripper outlet 16 while the sulfur contaminants are absorbed onto the sorbent packing material dumped in upper packing chamber 18 and lower packing chamber 20. The liquid feedstock is distributed uniformly across liquid distributor 22 and through apertures 23 (see liquid droplets generally throughout stripper as shown) to uniformly contact the sorbent packing dumped in upper chamber 18 and supported on packing support 26 which further supports the upper located medium sized packing 28 and lower located large sized packing 30, both packings positioned between the packing support and the dumped sorbent packing. The contaminant mercaptan sulfur contained in the feedstock reacts with the copper component of the packing sorbent in upper chamber 18 to produce copper sulfide which is deposited onto the sorbent packing.

The temperature in upper chamber 18 is regulated by addition of heat to a reboiler stream (not shown) through bottom inlet 50 to vaporize the light naphtha boiling fraction of the liquid feedstock on the surface of the sorbent packing and the light naphtha vapor is passed upwardly countercurrent to liquid droplets through openings 24 and is exited through top stripper outlet 16.

As the partially desulfurized liquid feedstock, containing an increased concentration of the heavy naphtha boiling fraction, is passed downwardly through openings 32 of packing support 26, the liquid is redistributed by redistributor 34 after passing through alternative feed zone 36. In a similar manner as in upper chamber 18, the redistributed partially desulfurized liquid feedstock (rich in heavy naphtha boiling fraction) is uniformly contacted with the dumped copper oxide sorbent packing in lower chamber 20 after passing through apertures 38 of redistributor 34 through openings 33 for further sulfur removal and light naphtha vaporization. Alternatively, additional heavy naphtha and/or light naphtha may be introduced into feed zone 36 through lines 12A. Lower chamber 20 is supported by packing support 40 which further supports more medium sized packing 28A and large sized packing 30A as in upper chamber 18. The further desulfurized liquid feedstock essentially in the form of the heavy naphtha boiling fraction is passed downward through openings 42 of packing support 40 and is collected in bottom portion 44 and exited through bottom stripper outlet 14. The desulfurized heavy naphtha is passed to a reformer unit (not shown). The vaporized light naphtha boiling fraction from lower chamber 20 is passed upwardly countercurrent to the liquid droplets through the apertures and openings of the packing supports, distributors and redistributors, and dumped sorbent packings, and exited from the stripper through top stripper outlet 16. At shutdown, the spent sorbent packings are removed from upper chamber 18 and lower chamber 20 through upper access manway 46 and lower access manway 48, respectively.

In view of the foregoing description of the invention including the examples thereof, it is evident that many alternatives, modifications, and variations can be made by those skilled in the art without departing from the concept of the present invention. Accordingly, it is intended in the invention to embrace all such alternatives, modifications, and variations as may fall within the scope of the appended claims.

I claim:

1. A process for separating at least one hydrocarbon-containing boiling fraction from a hydrocarbon-containing feedstock containing contaminants comprising sulfur, silicon, lead, or arsenic and at least two different hydrocarbon-containing boiling fractions, and concurrently removing said contaminants from said hydrocarbon-containing feedstock, said process comprising contacting sorbent packings comprising at least one active metal component supported on a porous refractory oxide and contained in a fixed bed in a distillation column with said feedstock under conditions for concurrent contaminant absorption and hydrocarbon distillation including the absence of added free hydrogen to concurrently (1) deposit at least a portion of said contaminants from said feedstock onto said sorbent packings in the form of active metal-contaminant products and (2) distill said feedstock into at least two different hydrocarbon-containing boiling fractions.

2. The process defined in claim 1 wherein said contaminants comprise sulfur or silicon, and compounds contained in said different hydrocarbon-containing boiling fractions do not change chemical composition.

3. The process defined in claim 1 wherein said sorbent packings comprise at least one active metal component supported on a porous refractory oxide.

4. The process defined in claim 1 wherein said feedstock comprises at least a portion selected from the group consisting of straight run naphthas, light naphthas, heavy naphthas, coker naphthas, virgin naphthas, cracked naphthas, reformer feedstocks, isomerization feedstocks, products from a hydrocracking process, distillate fuels, jet fuel, kerosene, gas oils, vacuum fractions, aromatics, recycle oils, cracked gasoline, and decant oils.

5. The process defined in claim 1 wherein said contaminants comprise sulfur in the form of mercaptans.

6. The process defined in claim 1 wherein said sorbent packings have a crush strength sufficient to support themselves in said distillation column and have a surface area sufficient to allow mass transfer thereon.

7. The process defined in claim 3 wherein said sorbent packings comprise shapes selected from the group consisting of Raschig rings, Lessing rings, Cross partition rings, Single spiral rings, Double spiral rings, Triple spiral rings, Berl saddles, and Intalox saddles.

8. The process defined in claim 1 wherein said feedstock contains sulfur contaminants in a concentration less than about 10 ppmw, calculated as S.

9. The process defined in claim 1 wherein said feedstock comprises a coker naphtha and said contaminant comprises silicon.

10. The process defined in claim 1 wherein said conditions comprise an elevated temperature in the range from about 200° F. to about 700° F. and the absence of added hydrogen.

11. A process for removing sulfur contaminants from a hydrocarbon-containing feedstock containing naphtha or jet fuel and less than 100 ppmw of said sulfur, calculated as S, the process comprising absorbing said sulfur onto a fixed bed of sorbent packings comprising at least one active metal component supported on a porous refractory oxide and contained in a distillation column during the distillation of said feedstock into two or more hydrocarbon-containing boiling fractions of said feedstock and in the absence of added free hydrogen, said sulfur absorbed onto said sorbent packings in the form of active metal-sulfur products.

12. The process defined in claim 11 wherein said sorbent packings comprise at least one active metal component selected from the group consisting of copper, nickel and zinc, and a porous refractory oxide comprising alumina.

13. The process defined in claim 11 wherein said feedstock comprises a reformer feedstock or at least one of said boiling fractions comprise a reformer feedstock.

14. The process defined in claim 11 wherein said feedstock or one of said boiling fractions further comprises an isomerization unit feedstock.

15. The process defined in claim 11 wherein said boiling fractions comprise a heavy naphtha or a light naphtha.

16. The process defined in claim 11 wherein said feedstock comprises about 0.1 to about 2 ppmw of said sulfur.

17. The process defined in claim 11 wherein said sorbent packings comprise copper components supported on gamma alumina.

18. The process defined in claim 11 wherein the temperature range during said distillation and absorption is in the range between 250° F. and 450° F.

19. The process defined in claim 11 wherein the compounds contained in said feedstock, except for compounds containing said sulfur contaminants, undergo essentially no change in composition during said distillation to said boiling fractions.

20. A process for separating one or more hydrocarbon-containing feedstocks comprising sulfur contaminants, and concurrently absorbing sulfur contained in at least one of said feedstocks in the form of mercaptans, said process comprising contacting sorbent packings comprising copper components supported on an alumina-containing porous refractory oxide with one or more of said feedstocks under sulfur absorption conditions including the absence of added free hydrogen in a packed distillation column to absorb said sulfur from said mercaptan onto said sorbent in the form of active metal-sulfur products comprising copper sulfide, and concurrently distilling at least two different hydrocarbon-containing boiling fractions of said feedstocks and at least one of said boiling fractions having a reduced mercaptan content.

21. The process defined in claim 20 wherein at least one of said feedstocks comprises a naphtha or a jet fuel and said sulfur absorption conditions include a temperature in the range from 250° F. to 450° F.

22. The process defined in claim 20 wherein at least one of said feedstocks comprises a reformer feedstock having a sulfur concentration less than 10 ppmw, calculated as S.

23. The process defined in claim 22 wherein said sorbent packings comprise shapes selected from the group consisting of Raschig rings, Lessing rings, Cross partition rings, Single spiral rings, Double spiral rings, Triple spiral rings, Berl saddles, and Intalox saddles.

24. The process defined in claim 22 wherein said distillation column comprises a side stripper from a main fractionator and, on the surface of said packings, vapor comprising one of said boiling fractions is released from the liquid form of one of said feedstocks.

25. The process defined in claim 1 wherein said distillation column is a main fractionator and, on the surface of said packings, vapor comprising a product fraction is released from the liquid form of said feedstock and vapor comprising said feedstock is condensed to a liquid form of said boiling fraction.

26. The process defined in claim 11 wherein said distillation comprises liquid-to-vapor, liquid-to-liquid, and vapor-to-liquid conversions on the surface of said packings.

27. The process defined in claim 21 wherein at least one of said feedstocks comprises an isomerization feedstock comprising a light naphtha having a sulfur concentration less than 10 ppmw, calculated as S.

28. The process defined in claim 21 wherein at least one of said feedstocks is a jet fuel derived from a shale oil.

29. The process defined in claim 21 wherein at least one of said boiling fractions distilled from said feedstock comprises a jet fuel which passes specification for copper strip corrosion for jet fuels.

30. A petroleum refining process comprising concurrent distillation and absorption and subsequent reforming or isomerizing a hydrocarbon-containing feedstock, said process comprising the following steps:

(1) contacting a feedstock comprising a naphtha containing less than 0.01 weight percent of organosulfur contaminants, calculated as S, with sorbent packings in a fixed bed contained in a distillation column to absorb at least a portion of sulfur onto said sorbent, and concurrently, to separate a boiling fraction comprising said naphtha having a reduced organosulfur content from said feedstock by distillation, said sorbent packings containing at least one active metal component supported on a porous refractory oxide, and (2) contacting said naphtha obtained from step (1) with a catalyst under reforming or isomerization conditions to produce upgraded hydrocarbon-containing products.

* * * * *